US007338425B1

(12) United States Patent
Whitten et al.

(10) Patent No.: US 7,338,425 B1
(45) Date of Patent: Mar. 4, 2008

(54) VARIABLE LENGTH CUTTING DEVICE

(75) Inventors: David Elliott Whitten, Barrington, NH (US); Eugene John Bergeron, Barrington, NH (US); Kevin Lauren Cote, Durham, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 09/481,640

(22) Filed: Jan. 12, 2000

(51) Int. Cl.
*B41F 13/62* (2006.01)
*B41L 43/08* (2006.01)
*B65H 37/06* (2006.01)

(52) U.S. Cl. ..... 493/424; 493/425; 493/475; 83/346

(58) Field of Classification Search ..... 83/343, 83/346, 347, 246; 101/411; 226/44, 102, 226/114, 118.2; 242/364.11, 366.1; 270/18, 270/52.09, 52.17; 493/324, 356–360, 369, 493/370, 424–433, 434, 435, 442, 475, 476, 493/478
See application file for complete search history.

(56) References Cited

U.S. PATENT DOCUMENTS

| | | | | | |
|---|---|---|---|---|---|
| 687,905 | A | * | 12/1901 | Seymour et al. | 83/343 X |
| 908,156 | A | * | 12/1908 | Seymour | 83/343 |
| 1,284,983 | A | * | 11/1918 | Barber | 83/343 |
| 1,499,106 | A | * | 6/1924 | Halliwell | 493/360 |
| 1,578,436 | A | * | 3/1926 | Herb | 493/360 |
| 1,821,713 | A | * | 9/1931 | Johansen | 493/360 |
| 2,222,279 | A | * | 11/1940 | Barber | 83/346 X |
| 2,814,484 | A | * | 11/1957 | Stobb et al. | 493/370 X |
| 3,263,988 | A | * | 8/1966 | Heimlicher | 270/50 |
| 3,477,709 | A | * | 11/1969 | Neal et al. | 493/424 |
| 4,496,338 | A | * | 1/1985 | Michalik | 493/367 |
| 4,936,561 | A | * | 6/1990 | Mukai | 270/45 |
| 5,029,829 | A | * | 7/1991 | von Hein et al. | 493/424 X |
| 5,039,076 | A | * | 8/1991 | Fischer | 493/424 X |
| 5,057,064 | A | * | 10/1991 | Michalik | 493/8 |
| 5,201,701 | A | * | 4/1993 | Roettger et al. | 493/425 |
| 5,363,728 | A | * | 11/1994 | Elsner et al. | 83/346 X |
| 5,653,429 | A | * | 8/1997 | Michalik et al. | 270/8 |
| 5,782,464 | A | | 7/1998 | Höhle et al. | 270/19 |
| 5,846,177 | A | | 12/1998 | Mayr | 493/424 |
| 6,250,622 | B1 | * | 6/2001 | Fowler et al. | 493/424 X |
| 6,398,704 | B1 | * | 6/2002 | Shibuya et al. | 493/424 |

FOREIGN PATENT DOCUMENTS

| | | | | |
|---|---|---|---|---|
| CH | 250 235 | | 6/1948 | |
| DE | 3934673 C2 | | 7/1993 | |
| DE | 195 22 903 A1 | | 1/1997 | |
| GB | 1214339 | | 12/1970 | |
| JP | 57-131670 | * | 8/1982 | 493/430 |

OTHER PUBLICATIONS

"Goss exhibits futuristic concept press", Gerry Valerio, , pp. 1-4, date unknown.

* cited by examiner

*Primary Examiner*—Clark F. Dexter
(74) *Attorney, Agent, or Firm*—Laurence A. Greenberg; Werner H. Stemer; Ralph E. Locher

(57) ABSTRACT

A variable length cutting device includes a cutting cylinder and a transfer cylinder. The transfer cylinder cooperates with the cutting cylinder for cutting a ribbon into signatures having a desired cutoff length. An adjustable diameter portion of the transfer cylinder can be moved in a direction toward and away from the central axis of the transfer cylinder for adjusting the desired cutoff length of the signatures.

6 Claims, 6 Drawing Sheets

8
5
11'
4'
12
6
ø 1000.00
7'
14'
3
13
258.11
41.36
1
2
TOTAL = 299.468

VARIABLE LENGTH CUTTING DEVICE

BACKGROUND OF THE INVENTION

Field of the Invention

The invention generally relates to a cutting device for cutting a ribbon into signatures of a desired length. In particular, the invention relates to a variable length cutoff folder.

Web-fed printing presses generally have a folder located downstream of the printing unit. The folder cuts and folds a paper web or a ribbon in order to form signatures or sheets of a desired length.

Known variable length cutoff folders are generally divided into two main categories. The first category of variable length cutoff folders changes the size or length of the signatures by replacing portions of the folder unit, such as by replacing the collect cylinder, the cutting cylinder, or the jaw cylinder. This concept, while viable, is expensive and it takes a considerable amount of time to replace portions of the folder unit.

The second category of variable length cutoff folders speeds up the angular velocity of the cutting cylinder relative to the velocity of the ribbon and subsequently accelerates the signature in order to present the leading edge of the signature to a desired position on a transfer cylinder. A disadvantage of this technique results from the velocity difference between the cutting cylinder and the ribbon. With this technique, the circumferential velocity of the cutting cylinder must be equal to or greater than the velocity of the ribbon. If the circumferential velocity of the cutting cylinder is significantly greater than the velocity of the ribbon, in order to create a shortest possible signature, then the quality of the cut declines.

The transportation velocity of the signatures after the cut corresponds to the circumferential velocity or speed of the cutting cylinders. As the circumferential velocity of the cutting cylinder increases relative to the velocity of the ribbon, the velocity of the signatures must also increase relative to the velocity of the ribbon. This situation requires that the signatures are accelerated to the new, higher velocity. The acceleration of the signatures can cause an inconsistency in the position of the signatures. This inconsistency in signature position can cause problems with the quality of the signatures and the performance of the cutting system and consequently with the performance of an entire folder unit.

An adjustable folding apparatus for web fed printing presses is described in British Patent No. 1,214,339. The adjustable folding apparatus has a cutter blade cylinder which cooperates with a transfer cylinder to provide a web receiving nip. The transfer cylinder carries around its periphery groups of web engaging members. Each group has a gripper for engaging a leading edge of a web emerging from the nip, a fold blade cooperating with a fold blade jaw in a third cylinder, and a support cooperating with an associated blade in the cutter cylinder. The peripheral position of the gripper and the fold blade are adjustable relative to the peripheral position of the support about the axis of rotation of the transfer cylinder for adjusting the size of the sheets.

German Patent DE 39 34 673 C2 discloses a variable length cutting system for cutting a web. A web runs between a cutting cylinder and a mating cylinder of equal diameter. The cutting cylinder has blades provided on its periphery. The mating cylinder has elastic cutting strips which cooperate with the blades on the cutting cylinder for cutting the web. The blades and cutting strips are pivotable around pivot axes. The pivot axes are located inside the cylinders and are parallel to the cylinder axes. During a cutting operation, the blades and cutting strips are pivoted such that the blades and the cutting strips move with respect to a movement direction of the web. A disadvantage of the variable length cutting system disclosed in DE 39 34 673 C2 is that a rather complicated gear mechanism is required because the blades as well as the cutting strips have to perform a synchronized movement during each cutting operation.

From the article "Goss Exhibits Futuristic Concept Press" by Gerry Valerio, it is also known to use a removable, seamless shell on a cutting cylinder in order to achieve a variable cutoff. The cutoff is changed by removing one shell from the cutting cylinder and installing another thicker or thinner shell. In order to compensate for the adjustments in the cylinder diameters, the position of the cylinders with respect to each other has to be adjusted too. A disadvantage of using removable shells is that a different shell is necessary for each of the desired cutoff lengths.

SUMMARY OF THE INVENTION

It is accordingly an object of the invention to provide a cutting device for cutting a ribbon into signatures of a desired length which overcomes the above-mentioned disadvantages of the heretofore-known devices of this general type and which allows cutting signatures of different lengths without having to adjust the operating speed of the device and without having to replace components of the device.

It is in particular an object of the invention to provide a variable length cutoff folder which allows varying a signature length such that the transfer cylinder of the folder has control of the leading edge of the signature without having to adjust the speed of the transfer cylinder and without having to replace any components of the folder.

With the foregoing and other objects in view there is provided, in accordance with the invention, a variable length cutting device, comprising:

a cutting cylinder;

a transfer cylinder configured to cooperate with the cutting cylinder for cutting a ribbon into signatures having a desired cutoff length, the transfer cylinder having a central cylinder axis and a circumferential region; and an adjustable diameter portion disposed in the circumferential region of the transfer cylinder, the adjustable diameter portion connected to the transfer cylinder and being movable in a direction toward and away from the central cylinder axis for adjusting the desired cutoff length of the signatures.

The cutting device according to the invention can be easily adjusted to various signature lengths without having to replace components of the cutting device.

In accordance with another feature of the invention, the adjustable diameter portion is an adjustable roller movable in a direction toward and away from the central cylinder axis.

In accordance with yet another feature of the invention, a linear jack or an eccentric jack is connected to the adjustable diameter portion for moving the adjustable diameter portion toward and away from the central cylinder axis.

In accordance with a further feature of the invention, a gripper and a tucking blade are connected to the transfer cylinder in the circumferential region of the transfer cylinder at a fixed distance from the central cylinder axis, wherein the adjustable diameter portion is disposed between the gripper and the tucking blade. This has the advantage, that the cutting cylinder can remain in a fixed position with respect to the transfer cylinder even when the adjustable diameter portion is moved toward or away from the center of the transfer cylinder.

In accordance with yet a further feature of the invention, a cutting blade is fixed to the cutting cylinder and a cutting ledge is disposed in the circumferential region of the transfer cylinder for cooperating with the cutting blade, wherein the cutting cylinder and the transfer cylinder rotate in synchronism.

In accordance with an added feature of the invention, the transfer cylinder has a constant angular speed, which has the advantage that a complicated speed control for the transfer cylinder is not required.

In accordance with another feature of the invention, a gripper and a cutting ledge are each connected to the variable diameter portion, the gripper and the cutting ledge are movable toward and away from the central cylinder axis together with the variable diameter portion.

With the objects of the invention in view there is also provided, a variable length cutoff folder, comprising a cutting cylinder; a transfer cylinder configured to cooperate with the cutting cylinder for cutting a ribbon into signatures having a desired cutoff length, the transfer cylinder having a central cylinder axis and a circumferential region; an adjustable diameter portion disposed in the circumferential region of the transfer cylinder, the adjustable diameter portion connected to the transfer cylinder and being movable in a direction toward and away from the central cylinder axis for adjusting the desired cutoff length of the signatures; a jaw cylinder having a cylinder jacket and a jaw provided on the cylinder jacket; and a tucking blade provided in the circumferential region of the transfer cylinder and cooperating with the jaw for folding the signatures into the jaw.

The term ribbon is defined as any type of web material, such as a paper web or paper ribbon. The term signature is defined as any piece of material that is cut from the web material such as a sheet of paper.

Other features which are considered as characteristic for the invention are set forth in the appended claims.

Although the invention is illustrated and described herein as embodied in a variable length cutoff folder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
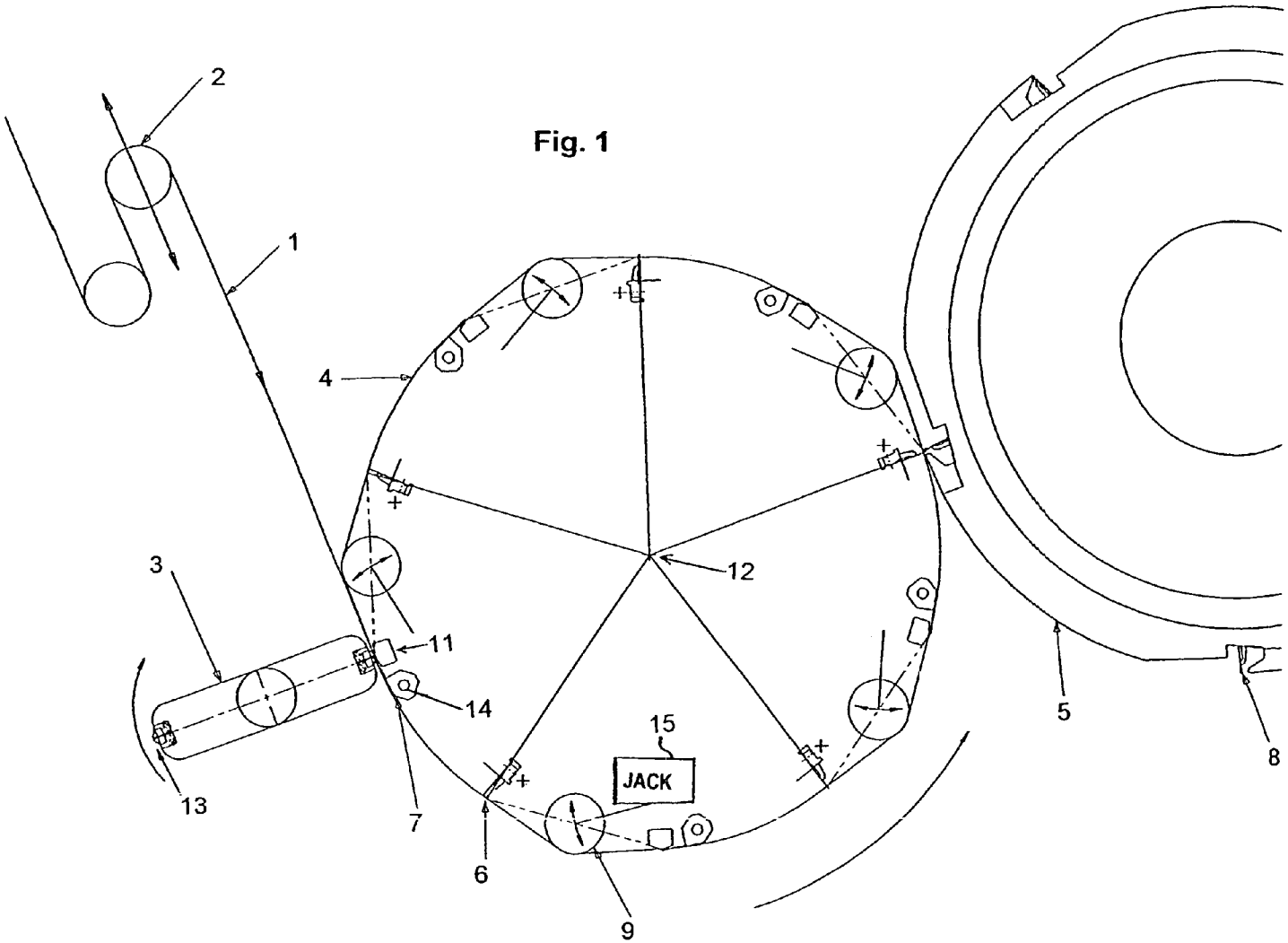
FIG. 1 is a diagrammatic side view of a first embodiment of a variable length cutoff folder according to the invention adjusted for an increased signature length.

Referring now to the figures of the drawings in detail and first, particularly, to FIG. 1 thereof, there is shown a diagrammatic side view of a first embodiment of a variable length cutoff folder. The folder has a rotary cutter 3, referred to herein as a cutting cylinder 3, a transfer cylinder 4, and a jaw cylinder 5.

The cutting cylinder 3 has cutting blades for cutting a ribbon 1 into signatures of a desired length. The transfer cylinder 4 has cutting ledges 11 that cooperate with the cutting blades 13 of the cutting cylinder 3 for cutting the ribbon 1 into signatures. Grippers 7 are provided on gripper shafts 14 and along the periphery of the transfer cylinder 4 for holding the signatures. Instead of using grippers as holding devices it is also possible to use pins or any other holding devices that are suitable for holding a leading edge. The transfer cylinder 4 also has adjustable diameter portions provided along its periphery. Each adjustable diameter portion is able to adjust the size of a portion of the transfer cylinder 4. Thus the effective diameter of the transfer cylinder 4 and the cutting cylinder 3 are adjustable to produce signatures of variable length. The adjustable diameter portions can for example be embodied as adjustable rollers 9. As is indicated by the arrows in the adjustable rollers 9, each adjustable roller 9 can be adjusted by a jack 15 such as an eccentric jack or a linear jack, or by any other suitable adjusting device. FIG. 1 illustrates how the size of adjustable portions of the transfer cylinder can be adjusted by retracting and extending the adjustable rollers 9, in other words by moving the adjustable rollers 9 toward and away from the central axis 12 of the transfer cylinder 4 for decreasing and increasing the size of the adjustable portions of the transfer cylinder 4.

The transfer cylinder 4 has tucking blades 6 provided along its periphery and the jaw cylinder 5 has jaws 8 provided along its periphery. The tucking blades 6 on the transfer cylinder 4 cooperate with the jaws 8 on the jaw cylinder 5 by folding the signature into the jaws 8.

A so-called dancer roll 2 is located in a region where the ribbon 1 enters the signature creation portion of the folder. The dancer roll 2 compensates for variations in the ribbon length such as variations caused by adjusting the effective diameter of the transfer cylinder 4.

Figure 2:
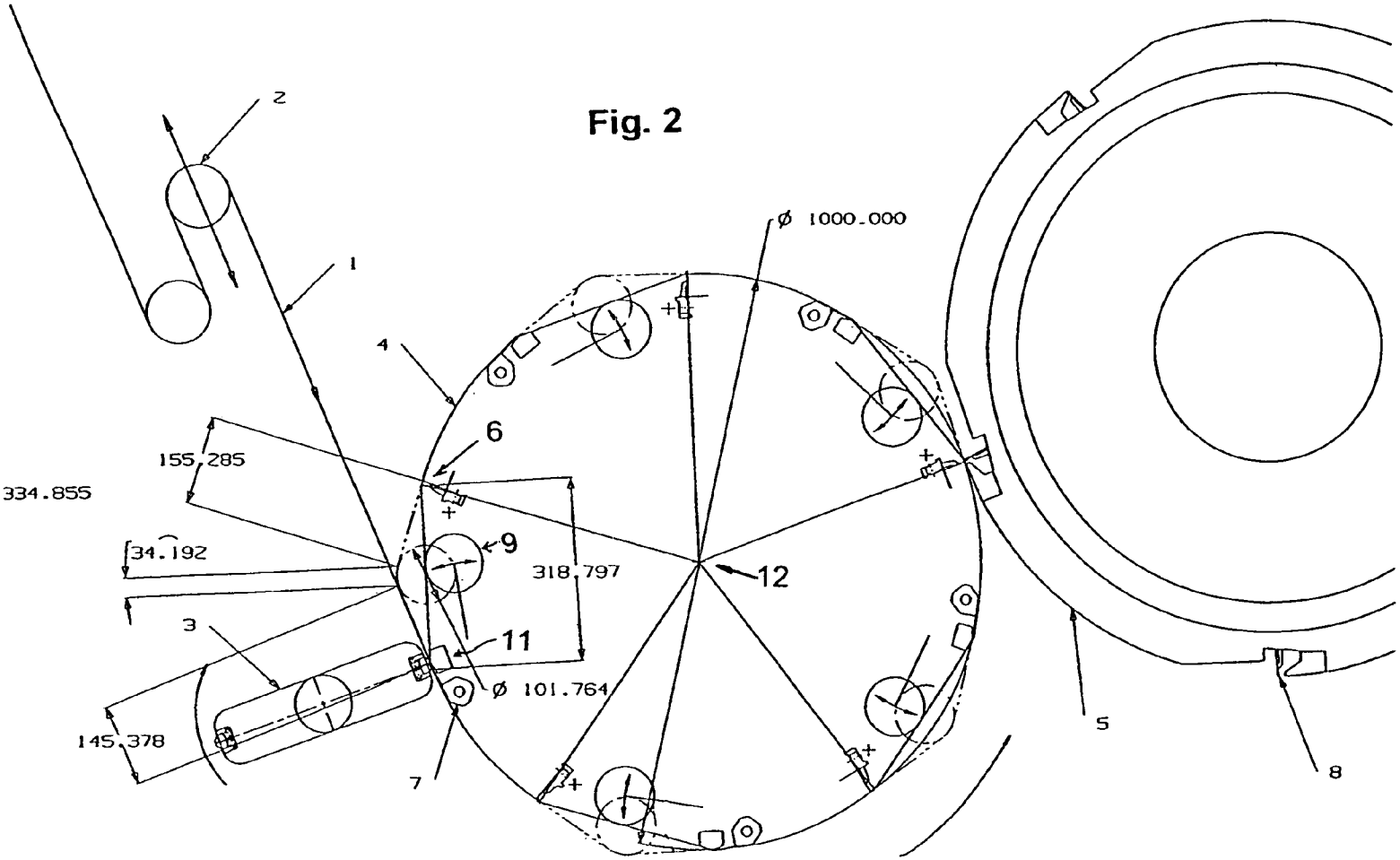
FIG. 2 is a diagrammatic side view of the variable length cutoff folder of FIG. 1 adjusted for a reduced signature length.

FIG. 2 is a diagrammatic side view of the variable length cutoff folder of FIG. 1 adjusted for a reduced signature length. The adjustable rollers 9 have been moved inward, in other words toward the central axis 12 of the transfer cylinder 4 in order to reduce the effective diameter of portions of the transfer cylinder 4 and thus to reduce the signature length. The dash-dotted lines indicate the positions of the adjustable rollers 9 for a signature having an increased length. FIG. 2 illustrates in an exemplary manner the dimensions of transfer cylinder 4. The diameter of the transfer cylinder 4 is shown to be 1000 mm, the diameter of the adjustable rollers 9 is 101.764 mm. When the adjustable roller 9 is moved to a position for cutting signatures having a reduced length, then the developed length of a line running from the cutting ledge 11 to the tucking blade 6 is 318.797 mm. In this case the line running from the cutting ledge to the tucking blade 6 is essentially a straight line. When the adjustable roller 9 is moved to the position for signatures having an increased length, then the developed length of a line between the cutting ledge 11 and the tucking blade 6 is 334.855 mm. The total length of 334.855 mm is the sum of the three lengths 155.285 mm, 34.192 mm, and 145.378 mm. The variation in length between the tucking blade 6 and the cutting ledge 11 is therefore 16.058 mm.

The operation of the variable length cutoff folder is explained with reference to FIGS. 1 and 2. The ribbon 1 is guided around the dancer roll 2 and enters the signature creation portion at the cutting cylinder 3 and the transfer cylinder 4. The dancer roll 2 allows variations in the ribbon length which are to be accommodated at the transfer cylinder 4. The variations are introduced by the adjustable roller 9 on the transfer cylinder 4 when it is extended for larger cutoffs. The cutting cylinder 3 and the transfer cylinder 4 rotate in opposite direction such that the blades 13 of the cutting cylinder meet the cutting ledges 11 of the transfer cylinder 4 during the rotation of the cylinders. The ribbon 1 is held on the transfer cylinder 4 through the use of a gripper, pin, or any other suitable holding device 7. As the transfer cylinder 4 rotates counterclockwise the ribbon is guided along the circumference of the transfer cylinder 4. The adjustable roller 9 is positioned such that the effective diameter of the transfer cylinder 4 in a region between the tucking blade 6 and the cutting ledge 11 or gripper 7 corresponds to a desired signature length. The grippers, pins, or holding devices 7 on the transfer cylinder 4 retain the signature. The transfer cylinder 4 then rotates in order to transport the signature to the jaw cylinder 5 and the tucking blade 6 folds the signature into the jaw 8. The signature length variation is accomplished due to the developed length or effective distance between the gripper 7 and associated tucking blade 6. The dimensions described with reference to FIG. 2 illustrate in an exemplary manner a possible difference in signature length or book length that can be achieved.

Figure 3:
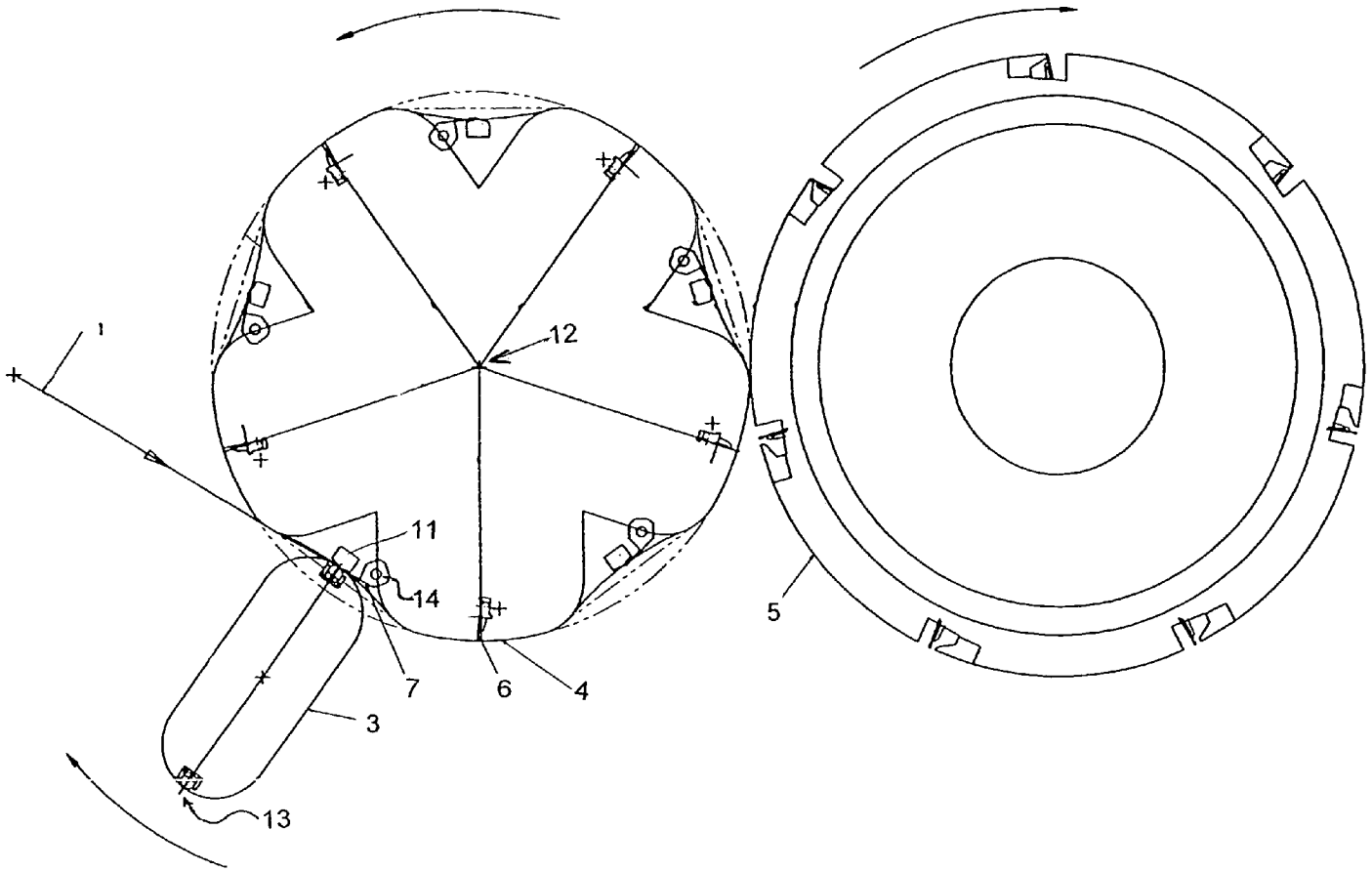
FIG. 3 is a diagrammatic side view of a second embodiment of a variable length cutoff folder according to the invention adjusted for a reduced signature length.
Figure 4:
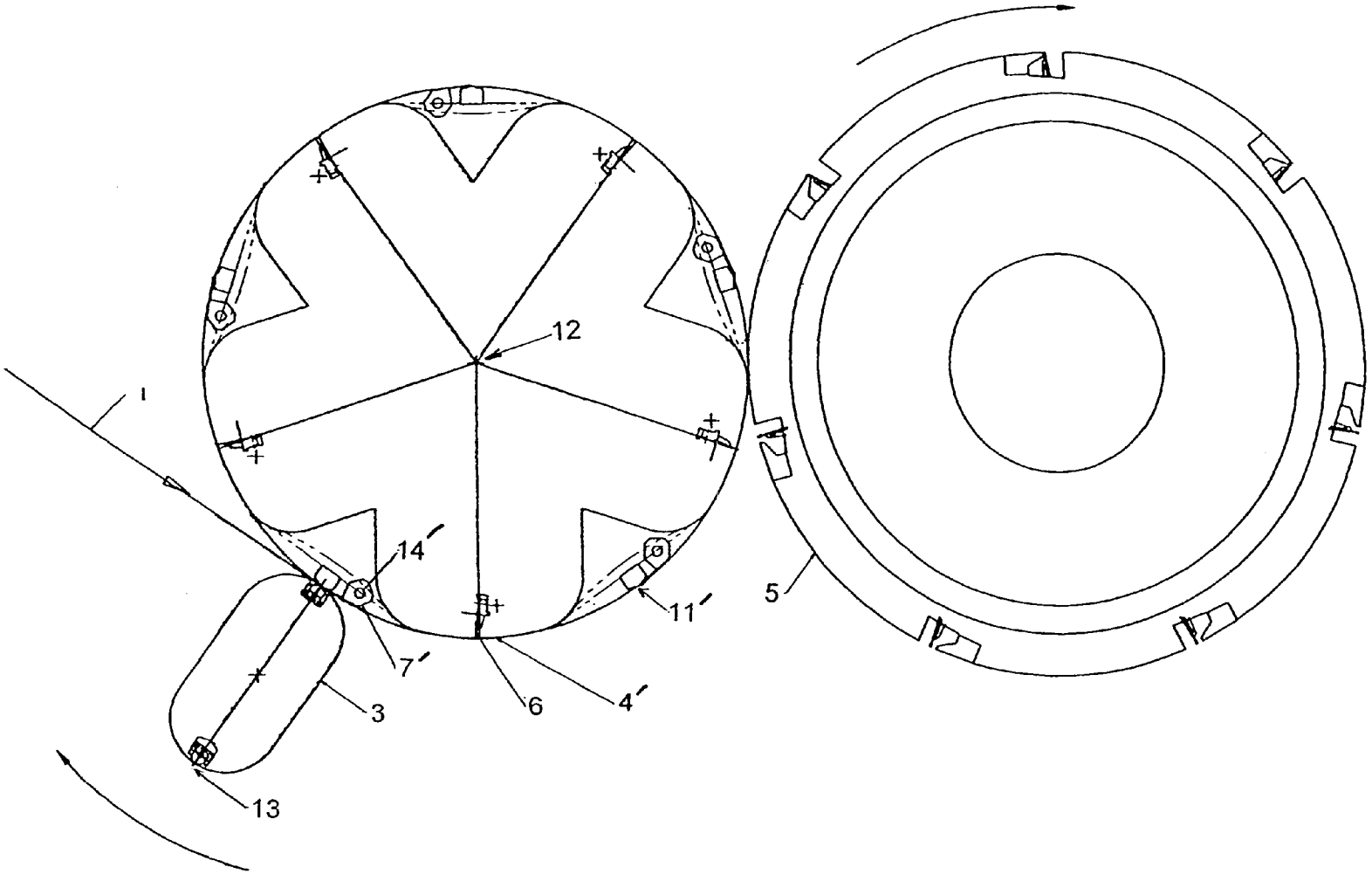
FIG. 4 is a diagrammatic side view of the variable length cutoff folder of FIG. 3 adjusted for an increased signature length.

FIG. 3 is a diagrammatic side view of a second embodiment of a variable length cutoff folder adjusted for a reduced signature length. Equivalent elements of the different embodiments are indicated with identical reference numerals. FIG. 3 shows a cutting cylinder 3 that can be moved toward and away from the transfer cylinder 4. The transfer cylinder 4 has cutting ledges 11 and holding devices 7 such as grippers or pins provided along the peripheral region of the transfer cylinder 4. The grippers 7 are mounted on gripper shafts 14. The grippers 7 together with the cutting ledges 11 can be moved toward and away from the central axis 12 of the transfer cylinder 4 in order to adjust the effective diameter of a portion of the transfer cylinder 4. FIG. 3 illustrates the position of the cutting ledge 11 and the gripper 7 in a retracted position for signatures having a reduced length. The cutting cylinder 3 is moved toward the transfer cylinder 4 so that the blades 13 of the cutting cylinder 3 contact the cutting ledges 11 during a cutting operation. If an increased signature length is desired, the cutting ledges 11 together with the grippers 7 are moved outward and away from the central axis 12 of the transfer cylinder 4, thus increasing the effective diameter of portions of the transfer cylinder 4. FIG. 4 illustrates the expanded position of the grippers (holding devices) 7' and the cutting ledges 11' for an increased signature length. The cutting cylinder 3 is moved away from the transfer cylinder 4' in order to cooperate with the cutting ledges 11'.

Figure 5:
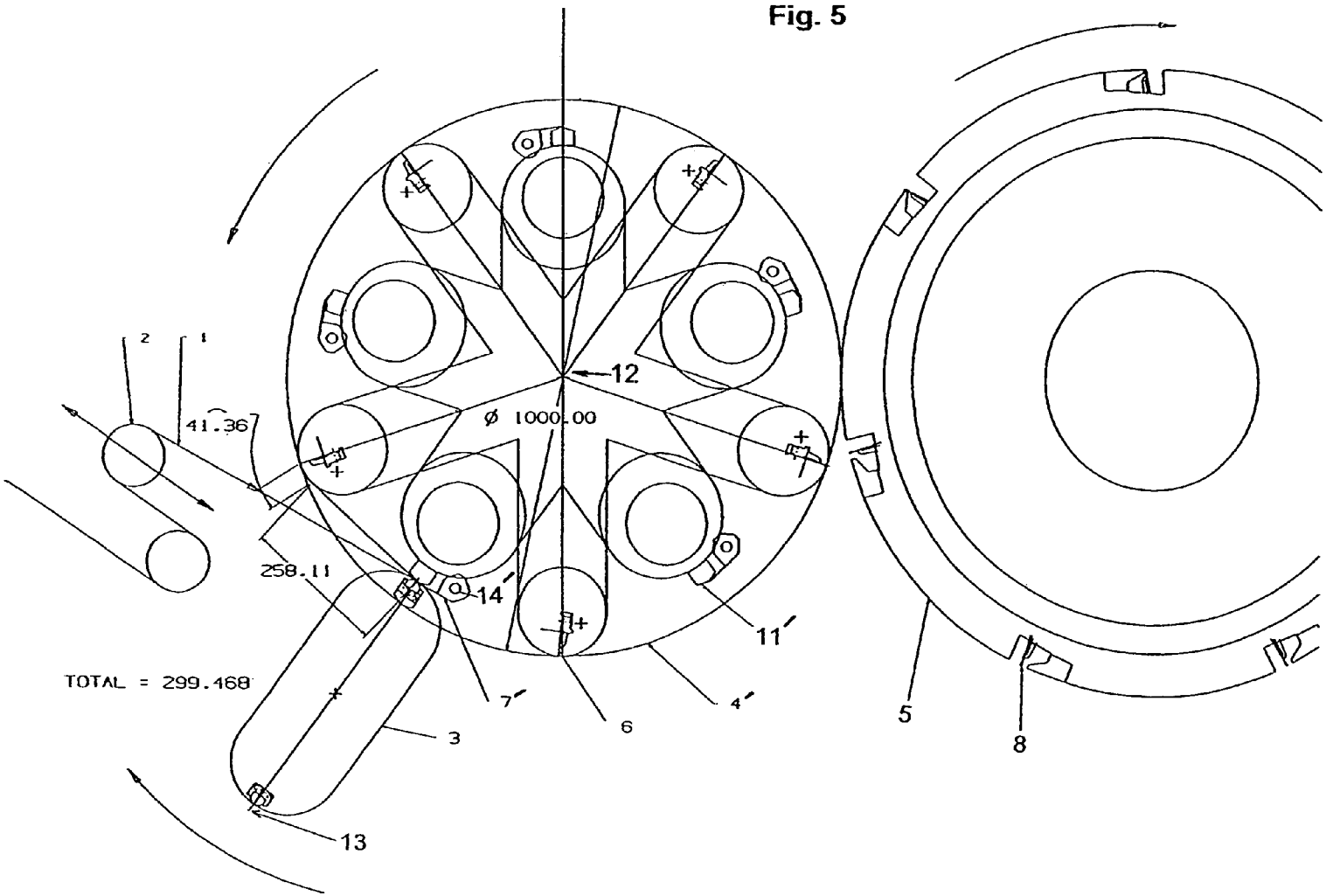
FIG. 5 is a cross-sectional view of the variable length cutoff folder shown in FIG. 3.

FIG. 5 is a cross-sectional view of the variable length cutoff folder shown in FIG. 3. FIG. 5 also illustrates a position of the cutting ledges 11' and the grippers 7' in a retracted position for signatures having a reduced length. In other words the cutting ledges 11' and the grippers (holding devices) 7' have been moved in a direction toward the central axis 12 of the transfer cylinder 4'. The cutting cylinder 3 has been moved toward the transfer cylinder 4' so that the blades 13 of the cutting cylinder 3 contact the cutting ledges 11' during a cutting operation. FIG. 5 illustrates in an exemplary manner the dimensions of the transfer cylinder 4'. The diameter of the transfer cylinder 4' is 1000 mm. The length of the ribbon 1, from the cutting ledge 11' to the next following tucking blade 6 is 299.47 mm, which is the sum of the straight line having a length of 258.11 mm and the curved line having a length of 41.36 mm as shown in FIG. 5.

Figure 6:
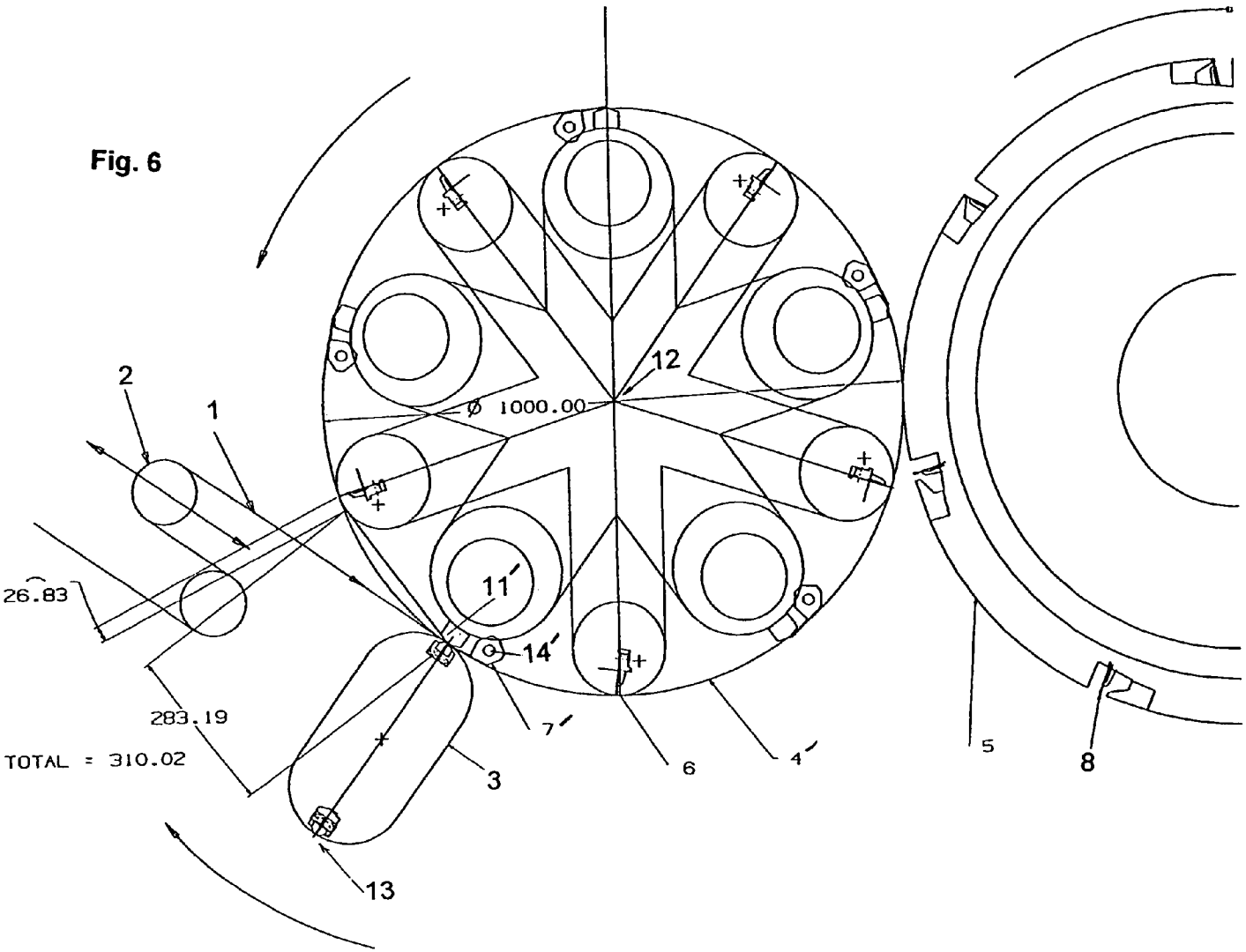
FIG. 6 is a cross-sectional view of the variable length cutoff folder shown in FIG. 4.

FIG. 6 is a cross-sectional view of the variable length cutoff folder shown in FIG. 4. The cutting ledges 11' and the grippers 7' are in an expanded position for signatures having an increased length. The cutting cylinder 3 has been moved away from the transfer cylinder 4' so that the blades 13 of the cutting cylinder 3 contact the cutting ledges 11' during a cutting operation. The diameter of the transfer cylinder 4' is 1000 mm. The length of the ribbon 1, from the cutting ledge 11' to the next following tucking blade 6 is 310.02 mm, which is the sum of the straight line having a length of 283.19 mm and the curved line having a length of 26.83 mm, as shown in FIG. 6.

We claim:

1. A variable length cutting device, comprising:

a rotary cutter; and a transfer cylinder cooperating with said rotary cutter for cutting a ribbon into signatures having a desired cutoff length, said transfer cylinder having a central cylinder axis, a circumferential region, a gripper and a tucking blade disposed in said circumferential region at a fixed distance from said central cylinder axis, and an adjustable diameter portion disposed between said gripper and said tucking blade in said circumferential region of said transfer cylinder, said adjustable diameter portion being movable in a direction toward and away from said central cylinder axis for adjusting the size of the circumference of the transfer cylinder to provide the desired cutoff length of the signatures, and said adjustable diameter portion being an adjustable roller movable in the direction toward and away from said central cylinder axis.

2. The variable length cutting device according to claim 1, which further comprises a dancer roller for compensating for variations in length of the ribbon.

3. A variable length cutting device, comprising:

a rotary cutter; and a transfer cylinder cooperating with said rotary cutter for cutting a ribbon into signatures having a desired cutoff length, said transfer cylinder having a central cylinder axis and a circumferential region, and an adjustable roller disposed in said circumferential region of said transfer cylinder, said adjustable roller being movable in a direction toward and away from said central cylinder axis for adjusting the size of the circumference of the transfer cylinder to provide the desired cutoff length of the signatures.

4. The variable length cutting device according to claim 3, further comprising:

one of a linear jack and an eccentric jack connected to said adjustable roller for moving said adjustable roller toward and away from said central cylinder axis.

5. The variable length cutting device according to claim 4, which further comprises a dancer roller for compensating for variations in length of the ribbon.

6. The variable length cutting device according to claim 3, which further comprises a dancer roller for compensating for variations in length of the ribbon.

* * * * *